United States Patent [19]

Reid

[11] Patent Number: 4,917,520

[45] Date of Patent: Apr. 17, 1990

[54] APPLICATOR BRUSH

[76] Inventor: Ginny Reid, 10443 N. May, Ste. 747, Oklahoma City, Okla. 73120

[21] Appl. No.: 293,427

[22] Filed: Jan. 4, 1989

[51] Int. Cl.[4] ..... A46B 11/00; A45D 34/00

[52] U.S. Cl. ..... 401/127; 401/126; 401/129

[58] Field of Search ..... 401/126, 127, 129; 141/24

[56] References Cited

U.S. PATENT DOCUMENTS

| | | | |
|---|---|---|---|
| 68,163 | 8/1867 | Barnet | 401/127 |
| 1,925,885 | 9/1933 | Van Kirk | 401/127 |
| 2,271,746 | 2/1942 | Schmalz . | |
| 2,736,050 | 2/1956 | Lee . | |
| 2,783,489 | 3/1957 | Bogoslowsky . | |
| 3,085,281 | 4/1963 | Massman . | |
| 3,087,191 | 4/1963 | Plunkett . | |
| 3,139,121 | 6/1964 | Ballin | 141/24 |
| 3,204,283 | 9/1965 | Damron . | |
| 3,209,387 | 10/1965 | Lukesch . | |
| 4,525,090 | 6/1985 | Riley et al. | 401/127 |

FOREIGN PATENT DOCUMENTS

| | | | |
|---|---|---|---|
| 3618046 | 5/1986 | Fed. Rep. of Germany | 401/127 |
| 1395217 | 3/1965 | France | 401/129 |
| 447501 | 3/1968 | Switzerland | 401/127 |

*Primary Examiner*—Steven A. Bratlie

*Attorney, Agent, or Firm*—Jerry T. Kearns

[57] ABSTRACT

An applicator brush for use in applying various liquids such as nail polish, glue, paste, liquid paper, etc., is designed for securement to bottles of the type having an externally threaded neck portion. A tubular cylindrical member has internal threads dimensioned for engagement with the externally threaded bottle neck portion and additionally is provided with external threads having a pair of axially extending diametrically opposed gaps. A hollow cylindrical cap member has a pair of diametrically opposed radially inwardly extending axially aligned lugs dimensioned for engagement with the external threads of the tubular cylindrical member and for axial sliding movement within the axially extending gaps. An elongated applicator shaft terminating in an applicator brush is secured to the cap member and extends centrally therethrough for insertion into the interior of the bottle. A coil spring surrounds the applicator shaft and has a first end secured to an end wall of the cap member and a second end disposed within the cap member for abutment with an upper end surface of the tubular cylindrical member. In use, the brush and cap may be alternatively threadedly connected to the threaded bottle neck portion or, through a relative rotation of not more than 90 degrees, the applicator shaft may be axially moved to access the bottle contents adjacent an interior floor of the bottle.

2 Claims, 3 Drawing Sheets

FIG. 3
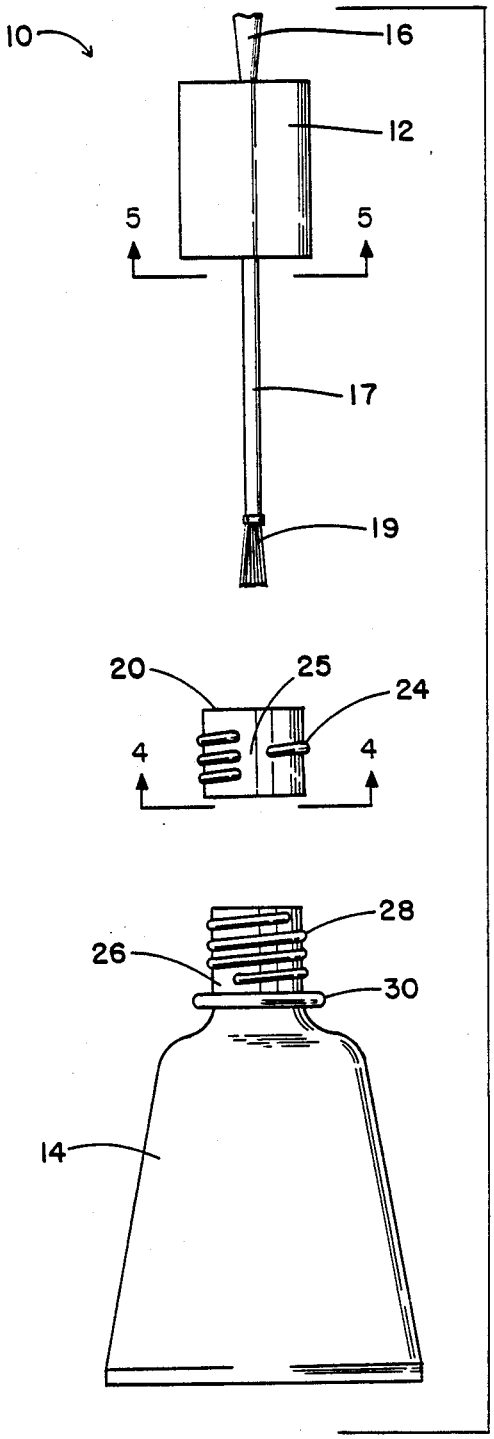
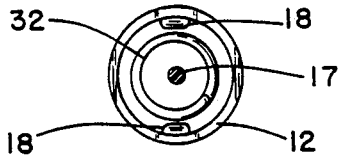
FIG. 5
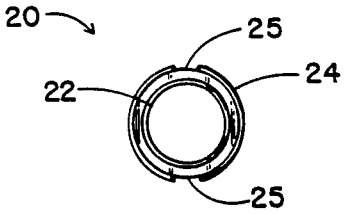
FIG. 4

APPLICATOR BRUSH

BACKGROUND OF THE INVENTION

1. Field of the Invention

The present invention relates to applicator brushes, and more particularly pertains to a new and improved applicator brush of the type utilized with bottles having externally threaded neck portions. Conventional forms of such applicator brushes utilize an applicator shaft secured to a cap member and provided with an applicator brush at a distal end thereof. The applicator shaft is dimensioned to abut the interior floor of the bottle when internal threads on the attached cap are completely engaged with the external threads on the bottle neck portion. This allows the remaining contents of a nearly empty bottle to be accessed by the applicator brush. However, when the cap is fully engaged on the bottle, the applicator brush bristles are bent and deformed by contact with the interior floor of the bottle. Over a period of time, this deformation becomes permanent, thus ruining the applicator brush. Of course it has been proposed to shorten the applicator shaft to maintain the applicator brush out of contact with the interior floor of the bottle, but this solution prevents the remaining contents of a nearly empty bottle from being utilized. In order to overcome these problems, the present invention provides an applicator brush and cap which may be threadedly secured to an externally threaded bottle neck portion with the applicator brush disposed above the interior floor of the bottle and which also provides for axial movement of the cap and attached applicator brush to access the remaining contents of a nearly empty bottle, when required.

2. Description of the Prior Art

Various types of applicator brushes with internally threaded cap members for engagement with an externally threaded neck portion of a bottle are known in the prior art. A typical example of such an applicator brush is to be found in U.S. Pat. 2,271,746, which issued to W. Schmalz on Feb. 3, 1942. This patent discloses a preformed cap having internal threads and a central internal recess for frictional securement to an applicator shaft. A plurality of lugs are provided on the applicator shaft to enhance securement of the shaft with the cap. U.S. Pat. 2,736,050, which issued to H. Lee on Feb. 28, 1956, discloses an applicator brush rigidly secured to an internally threaded cap. A bottle having an internal seal and an externally threaded neck portion cooperate with the cap. An enlarged handle portion on the cap forms an auxiliary reservoir for storing and supplying a liquid to an applicator brush. U.S. Pat. 2,783,489, which issued to B. Bogoslowsky on Mar. 5, 1957, discloses an applicator brush for use in applying lipstick and having an elongated shaft provided with a spherical pivot ball received in a cylindrical well of a lipstick container. The spherical pivot ball on the applicator shaft allows slight retraction and tilting of the brush while in the container to access the remaining contents. U.S. Pat. 3,085,281, which issued to I. Massman on Apr. 16, 1963, discloses a bottle having an externally threaded neck portion and provided with an internally threaded cap having an integrally formed applicator shaft and brush. The bottle is formed with internal mixing vanes for mixing nail polish contained therein. U.S. Pat. 3,087,191, which issued to R. Plunkett on Apr. 30, 1963, discloses a method for forming integrally molded plastic internally threaded caps and applicators. U.S. Pat. 3,204,283, which issued to W. Damron on Sept. 7, 1965, discloses a cap provided with an applicator shaft and brush and including a plurality of rotatable mixing vanes for mixing the contents of a bottle having an externally threaded neck portion. U.S. Pat. 3,209,387, which issued to H. Lukesch on Oct. 5, 1965, discloses a nail polish container having an externally threaded neck portion for engagement with an internally threaded cap including an elongated applicator shaft and brush.

While the above mentioned devices are suited for their intended usage, none of these devices disclose an applicator brush and cap which allows an applicator brush to be disposed above the interior floor of a bottle when stored and also allows sufficient axial movement of the cap and applicator brush to access the remaining contents of a nearly empty bottle. Additionally, none of the aforesaid devices disclose an applicator brush and cap which allow these advantages to be provided to conventional bottles having externally threaded neck portions. Additional features of the present invention, not contemplated by the aforesaid prior art devices include the provision of an applicator brush and cap which allows an individual to access the remaining contents of a nearly empty bottle by rotating the cap not more than 90 degrees with respect to the bottle. Inasmuch as the art is relatively crowded with respect to these various types of applicator brushes, it can be appreciated that there is a continuing need for and interest in improvements to such applicator brushes, and in this respect, the present invention addresses this need and interest.

SUMMARY OF THE INVENTION

In view of the foregoing disadvantages inherent in the known types of applicator brushes now present in the prior art, the present invention provides an improved applicator brush. As such, the general purpose of the present invention, which will be described subsequently in greater detail, is to provide a new and improved applicator brush which has all the advantages of the prior art applicator brushes and none of the disadvantages.

To attain this, a representative embodiment of the concepts of the present invention is illustrated in the drawings and makes use of an applicator brush for use in applying various liquids such as nail polish, glue, paste, liquid paper, etcetera which is designed for securement to bottles of the type having an externally threaded neck portion. A tubular cylindrical member has internal threads dimensioned for engagement with externally threaded neck portion of a bottle and additionally is provided with external threads having a pair of axially extending diametrically opposed gaps. A hollow cylindrical cap member has a pair of diametrically opposed radially inwardly extending axially aligned lugs dimensioned for engagement with the external threads of the tubular cylindrical member and for axial sliding movement within the axially extending gaps. An elongated applicator shaft terminating in an applicator brush is secured to the cap member and extends centrally therethrough for insertion into the interior of the bottle. A coil spring surrounds the applicator shaft and has a first end secured to an end wall of the cap member and a second end disposed within the cap member for abutment with an upper end surface of the tubular cylindrical member. In use, the brush and cap may be alternatively threadedly connected to the threaded bottle neck portion or through a relative rotation of not more than 90 degrees. The applicator shaft may be axially moved to access the bottle contents adjacent an interior floor of the bottle. The brush is stored within the bottle at a position elevated above the interior bottle floor to prevent deformation of the applicator brush.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved applicator brush which has all the advantages of the prior art applicator brushes and none of the disadvantages.

It is another object of the present invention to provide a new and improved applicator brush which may be easily and efficiently manufactured and marketed.

It is a further object of the present invention to provide a new and improved applicator brush which is of a durable and reliable construction.

An even further object of the present invention is to provide a new and improved applicator brush which is susceptible of a low cost of manufacture with regard to both materials and labor, and which accordingly is then susceptible of low prices of sale to the consuming public, thereby making such applicator brushes economically available to the buying public.

Still yet another object of the present invention is to provide a new and improved applicator brush which provides in the apparatuses and methods of the prior art some of the advantages thereof, while simultaneously overcoming some of the disadvantages normally associated therewith.

Still another object of the present invention is to provide a new and improved applicator brush which is stored in a position disposed above an interior floor of a bottle and is mounted for axial movement to allow the remaining contents of a nearly empty bottle to be utilized.

Yet another object of the present invention is to provide a new and improved applicator brush which may be axially moved to access the remaining contents of a nearly empty bottle after a rotation of an attached cap of not more than 90 degrees.

Even still another object of the present invention is to provide a new and improved applicator brush which may be manipulated with one hand of an individual to access the remaining contents of a nearly empty bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an exploded side view illustrating the various components of the applicator brush of the present invention.

FIG. 4 is a bottom view of the internally and externally threaded tubular cylindrical member, taken along line 4—4 of FIG. 3.

FIG. 5 is a cross sectional view illustrating the elongated applicator shaft and attached cap member, taken along line 5—5 of FIG. 3.

DESCRIPTION OF THE PREFERRED EMBODIMENT

Figure 1:
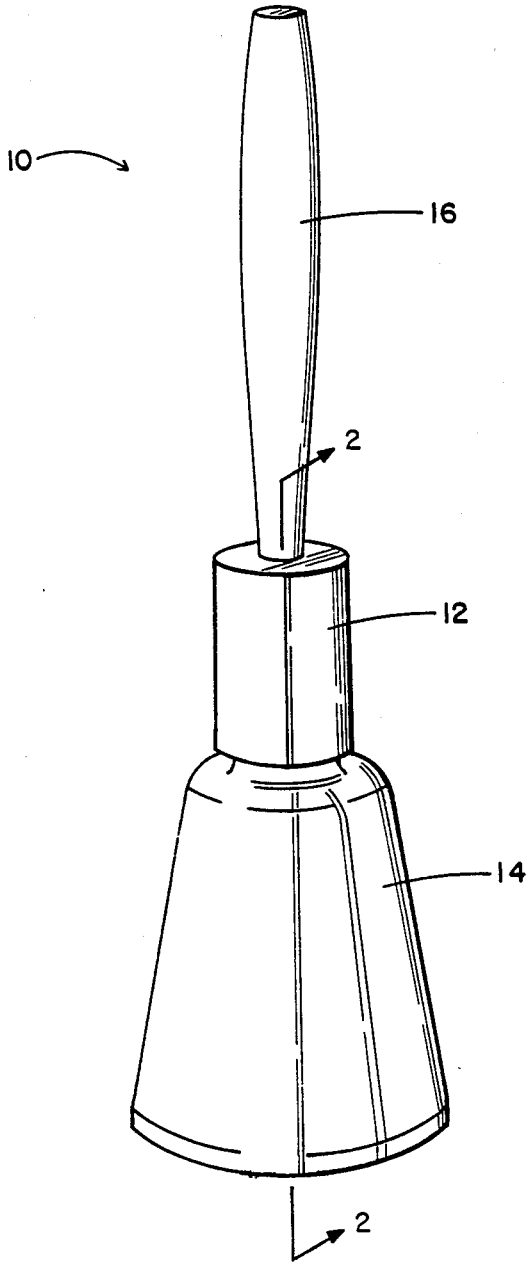
FIG. 1 is a perspective view of the applicator brush of the present invention provided on a conventional bottle.

With reference now to the drawings, and in particular to FIG. 1 thereof, a new and improved applicator brush embodying the principles and concepts of the present invention and generally designated by the reference numeral 10 will be described.

More specifically, it will be noted that the first embodiment 10 of the invention includes a hollow cylindrical cap member 12 which is secured on an externally threaded tapered neck portion of a conventional bottle 14. The cap 12 may optionally be provided with an elongated extension handle portion 16 to facilitate manipulation thereof. The applicator brush of the present invention may be utilized to apply nail polish, glue, paste, liquid paper and a variety of other liquid materials.

Figure 2:
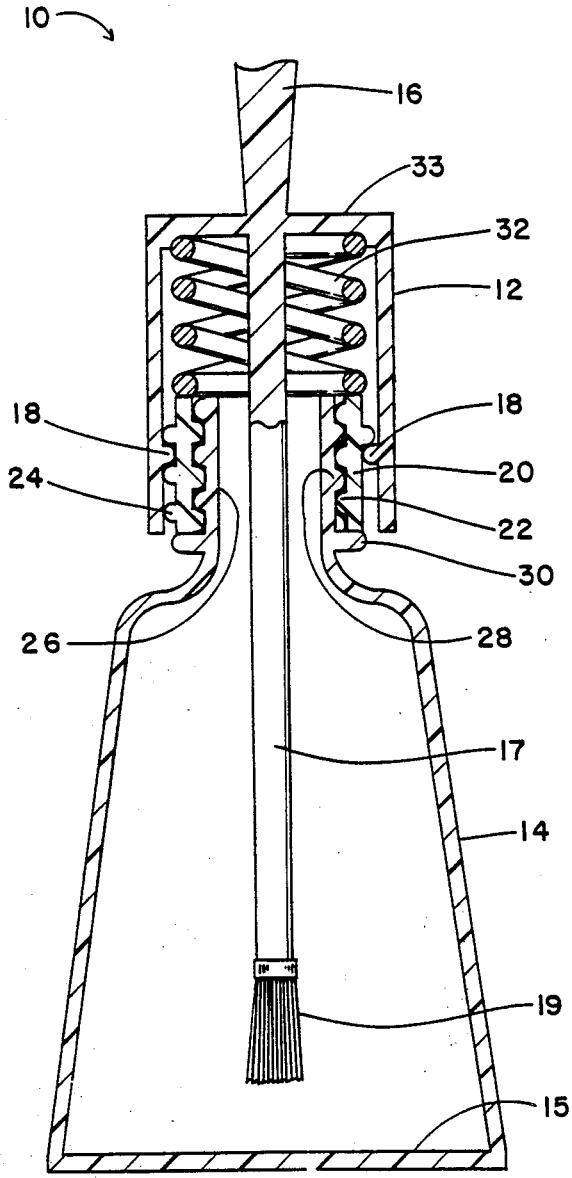
FIG. 2 is a longitudinal cross sectional view, taken along line 2—2 of FIG. 1.

As shown in FIG. 2, an elongated applicator shaft 17 extends centrally through the cap member 12 and is integrally formed therewith or alternatively may be formed separately and secured thereto. A tubular cylindrical member 20 has internal threads 22 dimensioned for engagement with external threads 28 provided on a tapered neck portion 26 of the bottle 14. The tubular cylindrical member 20 is also provided with external threads 24. A pair of diametrically opposed radially inwardly extending lugs 18 are provided in axial alignment within the hollow cylindrical cap member 12. The lugs 18 are dimensioned for engagement with the external threads 24 on the tubular cylindrical member 20. A coil spring 32 has a first end 33 secured to a first end wall of the cap member 12 and a second end disposed within the cap member 12 and adapted for abutment with an upper end surface of the tubular cylindrical member 20. The bottle 14 may be provided with an external radially extending flange 30 forming an abutment shoulder for engagement with a bottom end surface of the tubular cylindrical member 20. The elongated applicator shaft 17 is provided with an applicator brush 19 at a distal end portion. The shaft 17 and cap 12 are dimensioned to position the applicator brush 19 slightly above the interior floor surface 15 of the bottle 14. This prevents the brush 19 from being deformed by prolonged engagement with the interior floor 15. The cap 12 and attached applicator 17 and brush 19 are biased axially upwardly, away from the bottle 14 by the coil spring 32. In the illustrated position, the cap 12 is retained in engagement with the bottle 14 by the lugs 18 received between the external threads 24 on the tubular cylindrical member 20.

FIG. 3 provides an exploded side view which further illustrates the various components of the present invention. As illustrated in FIG. 3, an axially extending gap 25 is formed in the external threads 24 of the tubular cylindrical member 20. As shown in FIG. 4, a pair of diametrically opposed axial gaps 25 are preferably provided. As shown in FIG. 5, a pair of internal radially inwardly extending lugs 18 are provided within the cap member 12 and are dimensioned for engagement with the external threads 24 of the tubular cylindrical member 20 and are also dimensioned for axial sliding movement within the axially extending gaps 25.

As may now be readily understood with reference to FIG. 2, the applicator shaft 17 and brush 19 and attached cap 12 may at any time be disposed for relative axial movement with respect to the bottle 14 by rotating the cap 12 not more than 90 degrees with respect to the bottle 14. When the lugs 18 are situated in the axial gaps 25 of the tubular cylindrical member 20 (as shown in FIGS. 4 and 5), the cap 12 may be depressed axially against the bias of the spring 32. This allows the remaining contents to be accessed when the bottle 14 is nearly empty. When it is desired to store the bottle 14 and the contents thereof, the lugs 18 are engaged with the threads 24 and the cap 12 is tightened in a normal fashion. Thus, the present invention provides an applicator brush which allows access to the remaining contents of a nearly empty bottle by a one-handed manipulation of an individual, but which also allows the brush to be stored out of engagement with the interior floor of the bottle to prevent permanent deformation.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. An applicator brush for attachment to a bottle having an externally threaded bottle neck portion, comprising:

a tubular member having internal threads dimensioned for engagement with the external threads on the bottle neck portion;

said tubular member having external threads;

circumferentially spaced axial gaps formed in said external threads on said tubular member;

a hollow cap member having a first end wall and a second opposite open end;

a plurality of radially inwardly extending lugs in axial alignment within said cap member;

said lugs dimensioned for engagement with said external threads of said tubular member and for axial sliding engagement in said axial gaps;

an elongated applicator shaft extending through said cap member and secured thereto;

said applicator shaft having a distal end terminating in an applicator tip;

a coil spring surrounding said applicator shaft in coaxial relation therewith; and a first end of said spring secured to said first end wall of said cap member and a second end of said spring disposed within said cap member for abutment with an upper end surface of said tubular member, whereby said cap member may be selectively secured against axial movement to said tubular member or disposed for axial sliding movement of said cap member with respect to said bottle upon not more than 90 degree rotation of said cap member with respect to said tubular member.

2. An applicator brush for attachment to a bottle having an externally threaded bottle neck portion, comprising:

a tubular cylindrical member having internal threads dimensioned for engagement with the external threads on the bottle neck portion;

said tubular cylindrical member having external threads;

diametrically opposed axial gaps formed in said external threads on said tubular cylindrical member;

a hollow cylindrical cap member having a first end wall and a second opposite open end;

a pair of diametrically opposed radially inwardly extending lugs in axial alignment within said cylindrical cap member;

said lugs dimensioned for engagement with said external threads of said tubular cylindrical member and for axial sliding engagement in said axial gaps;

an elongated applicator shaft extending centrally through said cylindrical cap member and secured thereto;

said applicator shaft having a distal end terminating in an applicator brush;

a coil spring surrounding said applicator shaft in coaxial relation therewith; and a first end of said spring secured to said first end wall of said cap member and a second end of said spring disposed within said cap member for abutment with an upper end surface of said tubular cylindrical member, whereby said cap member may be selectively secured against axial movement to said tubular member or disposed for axial sliding movement of said cap member with respect to said bottle upon not more than 90 degree rotation of said cap member with respect to said tubular member.

* * * * *